US006527606B1

(12) United States Patent
Baret et al.

(10) Patent No.: US 6,527,606 B1
(45) Date of Patent: Mar. 4, 2003

(54) PROCESS FOR THE MANUFACTURE OF A PLASMA PANEL

(75) Inventors: Guy Baret, Grenoble (FR); Pierre Paul Jobert, Nicolas de Macherin (FR)

(73) Assignee: THOMSON Licensing S. A., Boulogne Cedex (FR)

( * ) Notice: Subject to any disclaimer, the term of this patent is extended or adjusted under 35 U.S.C. 154(b) by 0 days.

(21) Appl. No.: 09/550,275

(22) Filed: Apr. 13, 2000

(30) Foreign Application Priority Data

Apr. 15, 1999 (FR) ..... 99 04704

(51) Int. Cl.[7] ..... H01J 9/24
(52) U.S. Cl. ..... 445/24; 313/493
(58) Field of Search ..... 445/24; 313/582, 313/586, 580, 493

(56) References Cited

U.S. PATENT DOCUMENTS

| | | | | |
|---|---|---|---|---|
| 4,037,130 A | | 7/1977 | Mimitsuka et al. | 313/220 |
| 5,853,446 A | * | 12/1998 | Carre et al. | 65/17.3 |
| 6,247,986 B1 | * | 6/2001 | Chiu et al. | 445/24 |

FOREIGN PATENT DOCUMENTS

| | | | |
|---|---|---|---|
| EP | 0837486 A2 | 4/1998 | H01J/9/24 |
| EP | 0875915 A2 | 4/1998 | H01J/9/20 |
| JP | 07 045200 | 2/1995 | H01J/17/04 |
| JP | 10 340668 | 6/1997 | H01J/9/02 |
| JP | 11 054029 | 2/1999 | H01J/9/02 |

OTHER PUBLICATIONS

*Patent Abstractsof Japan, vol. 1999, No. 05, May 31, 1999.

**Patent Abstracts of Japan, vol. 1999, No. 03, Mar. 31, 1999.

***Patent Abstracts of Japan, vol. 1995, No. 05, Jun. 30, 1995.

French Search Report dared: Dec. 15, 1999.

* cited by examiner

*Primary Examiner*—Ashok Patel
*Assistant Examiner*—Thelma Sheree Clove
(74) *Attorney, Agent, or Firm*—Joseph S. Tripoli; Joseph J. Laks; Carlos M. Herrera

(57) ABSTRACT

The present invention relates to a process for the manufacture of a plasma panel comprising two tiles facing each other and containing a plasma discharge gas, at least one of the tiles having an array of electrodes serving to define a number of discharge cells and an array of supporting barriers delimiting the cells, the barriers being made of a material giving them a high and open porosity. According to the process, the barriers 30 are formed in a single step using a paste comprising the said material and an organic resin.

18 Claims, 3 Drawing Sheets

PROCESS FOR THE MANUFACTURE OF A PLASMA PANEL

BACKGROUND OF THE INVENTION

The present invention relates to plasma panels (PP), that is to say flat display screens in which the displayed image consists of a number of light-discharge points. The light discharges are produced in a gas contained between two insulating tiles, each point corresponding to an intersection in electrode arrays borne by at least one of the tiles.

The present invention relates more particularly to a process for the manufacture of barriers on at least one of the tiles of the panel, these barriers themselves being structural elements well known in the PP field.

DESCRIPTION OF THE PRIOR ART

It is known that a PP comprises a two-dimensional matrix of cells organized in rows and columns, which is traced to the geometry of the electrode arrays. In this case, the barriers are relief elements intended to separate the rows or the columns of cells. In some panels, the barriers may also separate both the columns and the rows of cells, therefore forming a chequerboard pattern of the latter. The role of the barriers is multipurpose. Thus, by partitioning the space of each cell at least in the direction of the rows or of the columns, the barriers prevent a discharge in one cell from inducing undesirable discharges in neighbouring cells by the ionization effect. They thus prevent cross-torque phenomena.

Moreover, the barriers constitute optical screens between the neighbouring cells, allowing good confinement of the radiation emitted by each cell. This role is particularly important in colour PPs in which the neighbouring cells constitute dots of different colours, in order to form triads for example. In this case, the barriers ensure good saturation of the colours.

Furthermore, the barriers often act as spacers between the tiles of the panel. Thus, the fact that the barriers may have a height corresponding to the required separation between the two tiles may be exploited. In this case, the tile not provided with barriers rests on the tops of the barriers present on the other tile.

The barriers may have various structures. However, if they are intended to be supporting, they are conventionally made of a dense and hardened material. These supporting barriers must be able to withstand the considerable pressure exerted by one tile on the other. This is because, during the operation of vacuum-pumping the space between the two facing tiles, prior to introduction of the low-pressure discharge gas, the force exerted per unit area of barrier may be as much as $10^6$ pascals (10 kg/cm$^2$), depending on the ratio of the area of the barriers to the total area of the panel. In the current state of the art, the barriers are composed of a dense material, generally a glassy phase, which is sufficiently crush-resistant to maintain a constant space between the two tiles. These barriers are produced, for example, by screen-printing (in 10 to 20 successive layers) a paste containing a glass frit or by blasting a layer containing a glass frit. After producing the geometry of the barriers, these layers are fired at temperatures of between 450° C. and 600° C. (typically 550° C.) so as to densify the material and make it mechanically strong. However, the densified material always exhibits porosity throughout it and this porosity cannot be easily pumped during the operation of vacuum-pumping the panel, which lasts only a few hours (generally 4 to 15 hours at 150° C. to 350° C.). Even if this porosity is low, and even if the surface of the barriers is perfectly vitrified, outgassing may occur over the few tens of thousands of hours that constitute the lifetime of a plasma panel. Any contamination of the gas phase in a PP causes operational variations which may be manifested either in terms of the operating voltages or on the luminous efficiency or on their lifetime. To remedy this drawback, it has been proposed in French Patent Application No. 98/16093 in the name of Thomson Plasma to produce the barriers from a material giving them substantially open porosity, the porosity being advantageously also relatively high. For this purpose, the Applicant has discovered that if barriers with a high porosity are produced, it is possible to remove from them, during the vacuum pumping, practically all the molecules capable of outgassing, so that the risk of the panels subsequently outgassing hardly exists any more. This technical effect is all the more remarkable in that the duration of the vacuum-pumping step can be reduced from several hours to less than one hour, or even only thirty minutes, without the performance characteristics of the PP being affected thereby.

In patent application Ser. No. 98/16093, the barriers are produced by using conventional manufacturing processes, such as screen printing, blasting and photolithography. Thus, as illustrated in FIGS. 1*a* to 1*c*, the barriers are produced on a tile 1 having address electrodes X1, X2 . . . X5 . . . . For example, these barriers have, at the end of the manufacturing process, a 400 $\mu$m pitch, a 100 $\mu$m width and a 180 $\mu$m height, for a plasma panel having a working area corresponding to a 106 cm diagonal with TV resolution (560 rows, 700 columns). In a known manner, a thick layer of dielectric 2 and a thin layer of magnesium oxide or MgO have been deposited using conventional techniques on the tile 1 covered with the address electrodes.

The barriers are produced by photolithography of a pasty layer 10' deposited by screen printing on the thin MgO layer 3. The composition of the paste forming the layer is as follows:

- a mineral filler in the form of alumina particles having a mean particle diameter of 5 microns with a narrow particle size distribution;
- a glassy phase, which may be lead borosilicate or bismuth borosilicate at a level of 10% of the mass of the alumina and a photosensitive resin of the negative type, constituting 50% of the volume of the paste.

Using a doctor blade 20, the paste 10' is spread uniformly over the MgO layer 3 through a screen-printing mask 21 having an aperture corresponding to the aspect ratio of the working area of the tile, as illustrated in FIG. 1*a*. The layer of paste 10' is dried at 80° C. After this operation, it has a thickness of about 20 $\mu$m.

Next, a photolithography mask 22 is laid over the layer of paste 10'. The mask has an elongate-aperture pattern corresponding to the pattern of barriers to be printed on the MgO layer 3. Those parts of the layer which are revealed by the mask are exposed to ultraviolet radiation so as to make them resistant to the development, as illustrated in FIG. 1*b*.

Next, the layer 10' thus exposed is deposited in water or in water to which sodium carbonate has been added, depending on the type of resin used, and then the surface is dried using an air knife.

A first layer of barrier material 10' with an elementary height of approximately 20 $\mu$m is then obtained, as illustrated in FIG. 1*c*.

The above steps are repeated in succession until the total required height for the barriers is obtained. Each new deposition of paste 10', by screen printing, completely covers the working area of the tile, including the tops of the barriers being formed. Depending on the number of iterations of these steps, the vertical position of the screen-printing mask 21 or the depth of the latter is modified, depending on the variation in the deposited layers existing on the tile.

The process described in patent application Ser. No. 98/16093 requires several passes in order to be able to produce barriers having the required height. Typically, the process requires from 3 to 5 deposition operations since the individual thicknesses are small, of about 15 to 30 $\mu$m. In order to deposit barriers with a height of 150 $\mu$m, at least 5 layers are therefore required, with intermediate drying steps and a final firing at 400° C. to 520° C. for 20 to 60 minutes in order to stabilize the deposited structure and to burn off the organic compounds.

SUMMARY OF THE INVENTION

The object of the present invention is therefore to propose a process for the manufacture of the barriers which is much simpler and much more rapid.

As a consequence, the subject of the present invention is a process for the manufacture of a plasma panel comprising two tiles facing each other and containing a plasma discharge gas, at least one of the tiles having an array of electrodes serving to define a number of discharge cells and an array of supporting barriers delimiting the cells, the carriers being made of a material giving them a high and open porosity, characterized in that the barriers are formed in a single step using a paste comprising the said material and an organic resin.

Two standard processes may be used to manufacture the barriers in a single step, namely a moulding-type forming process or a transfer-type forming process.

According to a first mode of implementation, relating to the moulding-type forming process, this comprises the following steps:

- deposition of a uniform layer of paste on the tile receiving the barriers;
- application to the said layer of a mould having the pattern of barriers; and
- printing, by pressing the pattern into the deposited layer.

In this case, the organic resin contained in the paste is a thermoplastic resin which has, preferably, a softening temperature of between 60° C. and 200° C.

Typically, this organic resin includes compounds chosen from polyvinyl alcohol, polyvinylpyrrolidone and polyvinyl butyrate. In addition, the resin represents from 25 to 70% of the total mass of the paste. Moreover, in this process, the pressing is carried out at a temperature of between 70° C. and 150° C.

According to another mode of implementation, relating to transfer-type forming, the process comprises the following steps:

- filling a mould having the pattern of barriers with the said paste;
- pressing the mould onto the surface of the tile receiving the barriers; and
- adhesion of the paste by heating.

In this case, the organic resin contained in the paste comprises a curable compound which has a softening temperature of between 80° C. and 150° C., chosen from vinyl or cellulose compounds. In order to make the material of the paste adhere to that surface of the tile receiving the barrier, this surface is heated to a temperature of between 80° C. and 150° C.

The material of the barriers having a high and open porosity is identical in both modes of implementation. It is also identical to the material described in patent application Ser. No. 98/16093. Typically, this material includes a mineral filler in the form of a powder having a mean elementary particle diameter of between 1 and 20 $\mu$m. Preferably, the mineral filler is an oxide chosen from alumina and silica.

The material of the barriers may optionally include a hardening agent in an amount equal to or less than 10% of the mass of the mineral filler. This hardening agent is a glassy phase with, in the case of a glass, a softening temperature of less than the treatment temperature. This glassy phase is chosen from lead borosilicate, bismuth borosilicate and compounds such as lead sulphate, lead phosphate, zinc phosphate, sodium silicate, potassium silicate, lithium silicate and lead silicate, these being capable of forming chemical bonds at the treatment temperature.

According to another characteristic of the present invention, after forming the barriers, phosphors are deposited between them, using a conventional deposition process such as a screen-printing or photolithography process.

Once the phosphors have been deposited, the tile bearing the barriers is then subjected to a final firing at a temperature of between 400° C. and 500° C., preferably between 400° C. and 450° C., so as not to deform the tile which is made of glass. This is because the dimensional stability of the glass is difficult maintain above 460° C.

BRIEF DESCRIPTION OF THE DRAWINGS

Further characteristics and advantages of the present invention will be given in the description of various modes of implementation, the description below referring to the drawings appended hereto, in which.

DESCRIPTION OF PREFERRED EMBODIMENTS

To simplify the description in the figures, the same elements bear the same references.

Two particular processes will now be described, with reference to FIGS. 2*a* to 2*d* and 3*a* to 3*c*, allowing barriers with a high and open porosity to be produced in a single production step.

In both modes of implementation, a paste containing a filler and a resin is used, in which paste the filler is of the same type whatever the mode of implementation. The filler consists of a material as described in French Patent Application No. 98/16093. Preferably, this filler is a mineral filler in the form of a powder, the mean elementary diameter of the particles of which preferably lies within the 1 to 20 $\mu$m range, namely from 5 to 8 $\mu$m. This is because it has been found that a narrow particle size distribution, approximately between 5 and 8 $\mu$m, is well suited and gives the coating good cohesion. The barriers arising from this choice of particle size distribution are able to withstand a pressure ranging up to $7\times10^5$ pascals (approximately 7 kg/cm$^2$) without adding further elements and have maximum porosity. Preferably, the filler consists of an oxide such as alumina or silica. It may include a hardening agent in an amount equal to or less than 10% of the mass of the mineral filler.

Figure 1A:
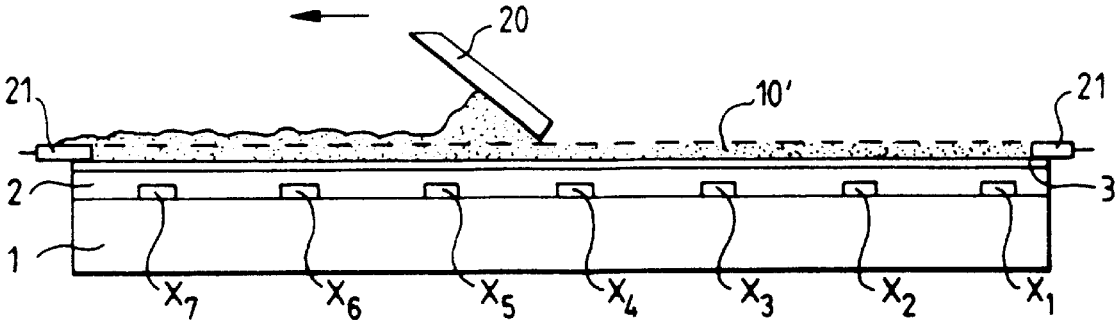
FIGS. 1 to 1*c*, already described, illustrate the main steps in a process according to the prior art.
Figure 1B:
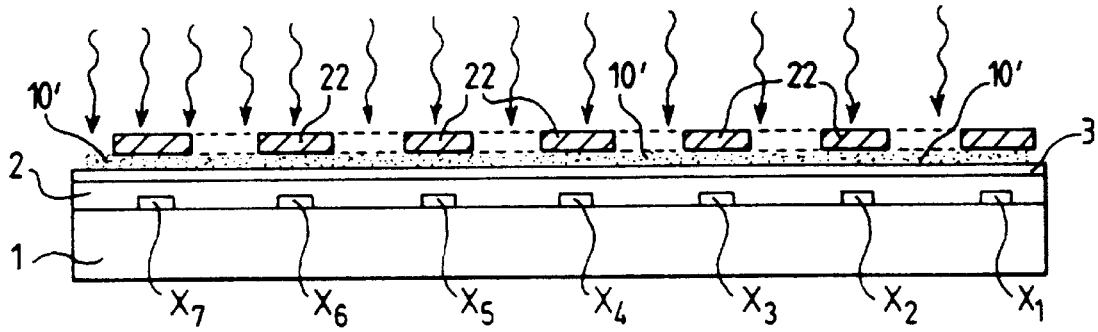
Figure 1C:
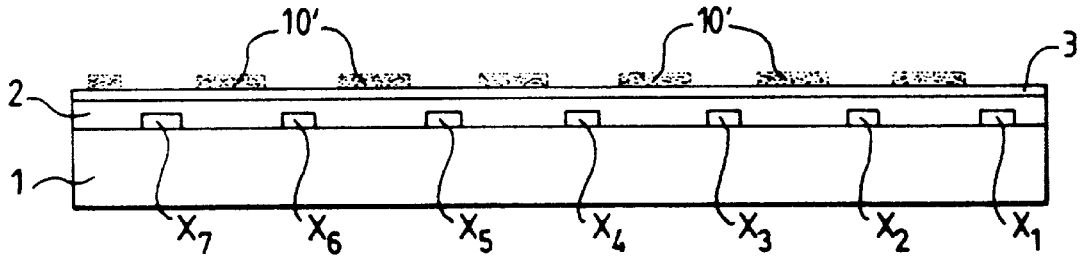

This hardening agent is chosen from a glassy phase, such as lead borosilicate or bismuth borosilicate or from a compound such as lead sulphate, lead phosphate, zinc phosphate, sodium silicate, potassium silicate or lead silicate, these being capable of forming chemical bonds at the treatment temperature. By way of example, the filler used in the modes of implementation below will consist of alumina having a mean diameter of 5 $\mu$m, combined with a hardening agent such as a lead silicate in an amount of 10% of the mass of alumina. In both modes of implementation, the filler is combined with a resin which forms the paste, which will be deposited on the MgO layer, as mentioned with reference to the modes of implementation illustrated in FIGS. 1*a* to 1*c*. Depending on the process used, the resin is a resin of the thermoplastic type having a softening temperature of between 60° C. and 200° C. This thermoplastic-type resin may contain compounds of the type such as polyvinyl alcohol or polyvinylpyrrolidone or polyvinyl butyrate. It represents from 25 to 70% of the total mass of the paste. For the other process, the resin consists of a curable compound having a softening temperature of between 80° C. and 150° C. This resin is chosen from vinyl or cellulose compounds. This type of compound allows good adhesion to the substrate.

Figure 2A:
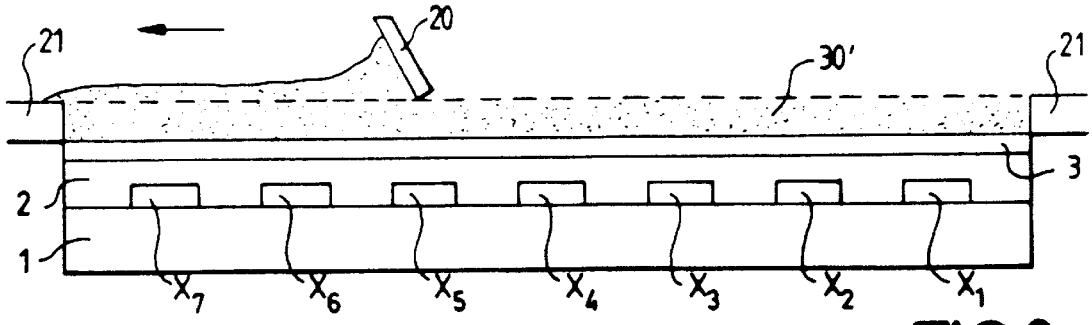
FIGS. 2*a* to 2*d* illustrate the main steps in a moulding-type process.

One embodiment of the barriers, produced using a moulding process, will be described more specifically with reference to FIGS. 2*a* to 2*d*. As illustrated in FIG. 2*a* the operations begin on a glass tile 1 provided beforehand with an array of address electrodes X1, X2 , . . . , X5 . . . , X7, this array being coated with a thick layer of dielectric 2 and with a thin layer 3 of magnesium oxide or MgO using the conventional techniques. In this embodiment, the barriers are produced by moulding a paste layer as described above. Thus, according to the present invention, the pasty layer 30' is deposited by screen printing onto the thin MgO layer 3. In this case, the composition of the paste consists of a mineral filler in the form of alumina particles having a mean elementary diameter of 5 $\mu$m with a narrow particle size distribution, of a glassy phase, in this case lead borosilicate amounting to 10% of the mass of alumina, and of a thermoformable resin, namely a polyvinyl alcohol, of reference 14–135, dissolved in water.

As illustrated in FIG. 2*a*, using the doctor blade 20 the paste 30 is deposited uniformly over the layer 3 through the screen-printing mask 21, which has an aperture corresponding to the aspect ratio of the working surface of the tile. Once the paste has dried, it has a thickness of about 30 $\mu$m, the thickness being defined by the volume of the barriers to be formed.

Figure 2B:
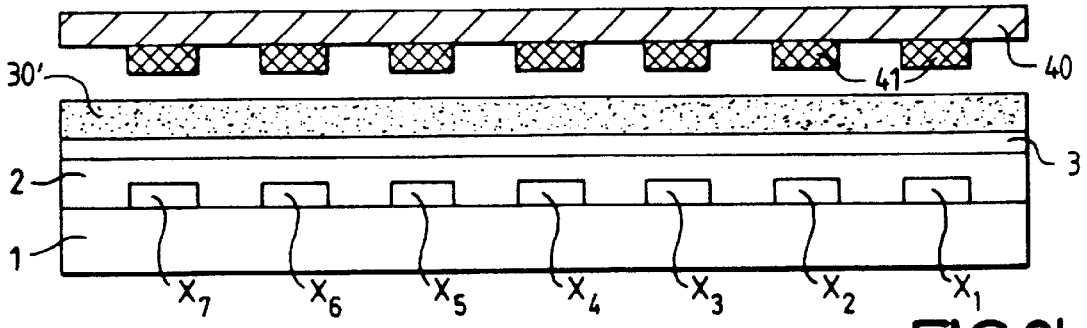

As illustrated in FIG. 2*b*, a metal mould 40 preferably covered with a non-stick layer, such as a fluorocompound of the type known by the brand name "Teflon", is used to produce the barriers. This mould 40 has projections 41 representing the pattern of the barriers to be formed.

Figure 2C:
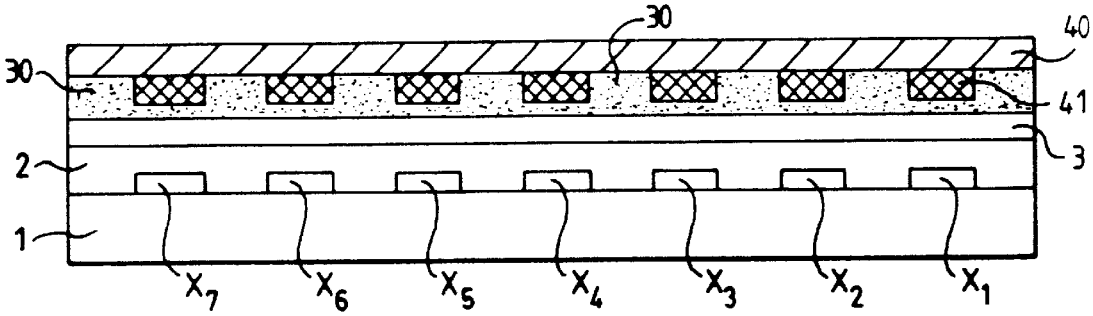
Figure 2D:
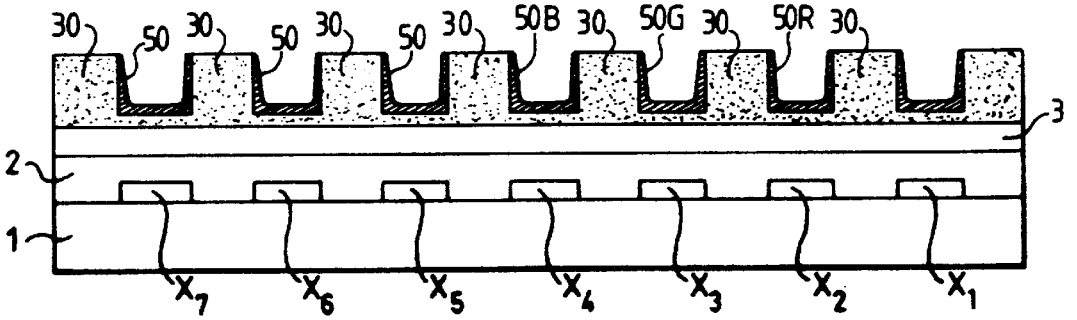

According to the present invention and as illustrated in FIG. 2*c*, the mould, heated to a temperature of approximately 90° C., is pressed against the substrate bearing the screen-printed layer 30'. The substrate may itself also be heated to a temperature of 90° C. It is obvious to those skilled in the art that it is possible to obtain the same result by heating either the tile with the layer to be formed or the mould, or both elements. This heating is carried out at a temperature of between 70° C. and 150° C. After the barriers 30 have been formed, the mould is removed and phosphors 50R, 50G, 50B are deposited in a manner known to those skilled in the art.

Thus, for each of the phosphors, a paste composed of a phosphor filler and a photosensitive resin in a volume ratio of 1:1 is prepared. This paste is uniformly deposited, by screen printing, over the working surface of the tile in order to form a layer thick enough to encapsulate the barriers. The photolithography mask has a cut-out pattern corresponding to the areas to be covered by the phosphor stripes. When all the phosphor stripes have been deposited, the assembly is fired at 420° C. for one hour in order to burn off the organic compounds. Thus, in this mode of implementation, the patterns of barriers are obtained in a single step. Moreover, a single final firing is carried out for the barriers and phosphors at a temperature of between 400° C. and 450° C., depending on the type of resin used, thereby making it possible to obviate any dimensional variations in the glass which occur above 450° C.

Figure 3A:
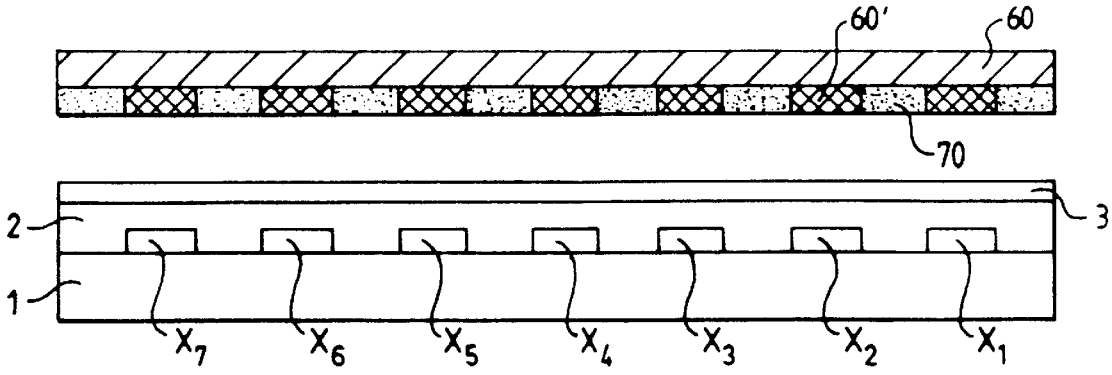
FIGS. 3*a* to 3*c* illustrate the main steps in a transfer-type process.

An embodiment of the barriers produced using a transfer-type process will now be described with reference to FIGS. 3*a* to 3*c*. As illustrated in FIG. 3A the substrate consists of a tile 1 provided with an array of electrodes X1, X2, . . . , X7, which array is covered with a thick layer of dielectric material 2, which is itself covered by a thin MgO layer 3. In the case of the transfer process, a mould 60 having the units 60' to be formed is used. This mould is filled with a paste 70' containing the filler as described above, combined with an organic resin which, in this case, consists of a curable compound chosen from vinyl or cellulose compounds. In order to allow the material of the paste to adhere to the substrate, the curable compound has a softening temperature of between 80° C. and 150° C.

Figure 3B:
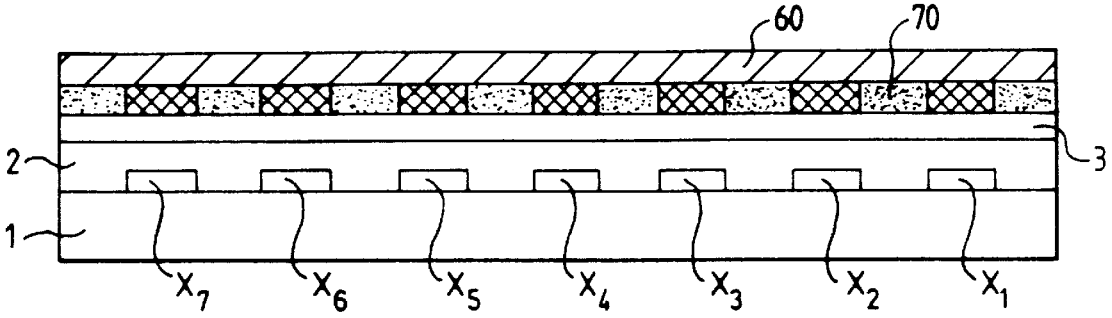
Figure 3C:
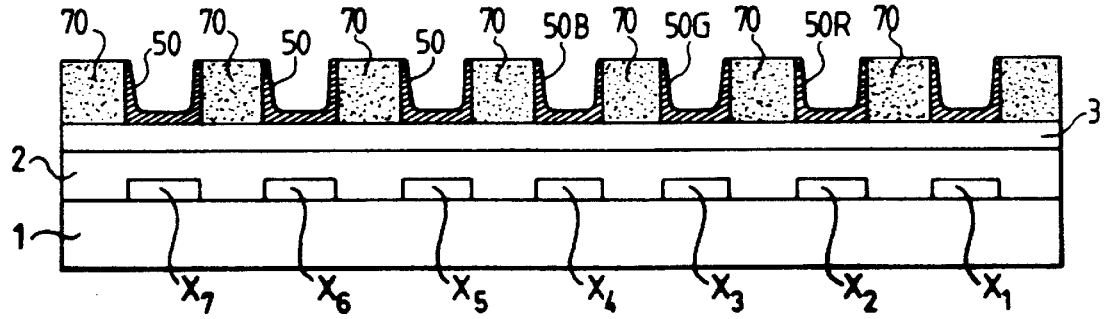

As illustrated in FIG. 3*b*, the mould provided with the paste 70' is applied to the upper surface of the substrate, namely to the surface of the MgO layer 3. To make the paste adhere to the substrate, the latter is heated to a temperature of between 80° C. and 150° C. In this way, the resin is made to cure and adhere to the MgO layer 3, so as to form barriers 70, as illustrated in FIG. 3*c*. The phosphors are then deposited in an identical way to that described with reference to FIG. 2*d*. Once the phosphors have been deposited, the assembly undergoes a final firing at a temperature of between 400° C. and 500° C., preferably between 400° C. and 450° C., in order not to deform the glass substrate. The curable compound is consequently a compound which completely decomposes between 400° C. and 450° C.

The manufacture of the barriers in a single step with a low firing temperature, which step can be carried out after the phosphors have been deposited, is also obtained with this barrier production technique.

The processes described above have a number of other advantages. In particular, the process does not generate contaminated residues such as those observed in the case of production by blasting. Moreover, the pumping of the panels is greatly facilitated because of the high porosity of the barriers. In addition, the materials used are less expensive than the conventional materials and the flatness constraints are less stringent than those in the case of dense barriers, since a local over-thickness of the barriers will be reduced by the local densification of the material to the mean height of the barriers when creating the vacuum in the plasma panel during the pumping cycle.

It is obvious to those skilled in the art that the moulding or the transfer may be used with other types of mould; in particular, the moulding may be carried out using a cylindrical-type mould and the transfer may also be carried out using a roller.

What is claimed is:

1. A process for the manufacture of a plasma panel comprising two tiles facing each other and containing a plasma discharge gas, at least one of the tiles having an array of electrodes serving to define a number of discharge cells and an array of supporting barriers delimiting the cells, comprising forming the barriers using a paste and an organic resin wherein said paste includes a material comprising a mineral filler;

depositing a uniform layer of said paste comprising said material and the organic resin on the tile receiving the barriers wherein the material of the barriers includes a hardening agent in an amount equal to or less than 10% of the mass of the mineral filler;

applying a mould having a pattern of barriers on said layer; and printing, by pressing the pattern into the deposited layer.

2. The process according to claim 1, wherein the organic resin contained in the paste is a thermoplastic resin.

3. The process according to claim 2, wherein the thermoplastic resin has a softening temperature of between 60° C. and 200° C.

4. The process according to claim 2, wherein the organic resin includes compounds chosen from the group consisting of polyvinyl alcohol, polyvinylpyrrolidone and polyvinylbutyrate.

5. The process according to claim 1, wherein the resin represents 25 to 70% of the total mass of the paste.

6. The process according to claim 1, wherein the pressing is carried out at a temperature of between 70° C. and 150° C.

7. The process according to claim 1, wherein the applying and printing steps are substituted by filling a mould having the pattern of barriers with said paste;

pressing the mould onto the surface of the tile receiving the barriers;

and adhering the paste by heating.

8. The process according to claim 7, wherein the organic resin contained in the paste comprises a curable compound.

9. The process according to claim 8, wherein the curable compound is vinyl or cellulose compounds.

10. The process according to claim 8, wherein the surface of the tile receiving the barriers is heated to a temperature of between 80° C. and 150° C. in order to make the paste adhere.

11. The process according to claim 1, wherein the mineral filler is in the form of a powder having a mean elementary particle diameter of between 1 and 20 $\mu$m.

12. The process according to claim 11, wherein the mineral filler is an oxide chosen from alumina and silica.

13. The process according to claim 7, wherein the hardening agent is a glassy phase, such as lead borosilicate or bismuth borosilicate, or a compound such as lead silicate, sodium, silicate, lithium silicate or potassium silicate, lead phosphate, or zinc phosphate, these being capable of forming chemical bonds at the temperature of the heat treatment.

14. The process according to claim 1, wherein the tile bearing the barriers is subjected to a final firing at a temperature of between 400° C. and 550° C.

15. The process according to claim 1, wherein the tile bearing the barriers is subjected to a final firing at a temperature of between 400° C. and 450° C.

16. The process according to claim 8, wherein the mineral filler is in the form of a powder having a mean elementary particle diameter of between 1 and 20 $\mu$m.

17. The process according to claim 7, wherein the tile bearing the barriers is subjected to a final firing at a temperature of between 400° C. and 550° C.

18. The process according to claim 8, wherein the tile bearing the barriers is subjected to a final firing at a temperature of between 400° C. and 450° C.

* * * * *